US010357981B2

(12) United States Patent
Araishi

(10) Patent No.: US 10,357,981 B2
(45) Date of Patent: Jul. 23, 2019

(54) UNIT CAPABLE OF BEING INSERTED IN AND PULLED OUT FROM IMAGE FORMING APPARATUS MAIN BODY AND IMAGE FORMING APPARATUS INCLUDING SAME

(71) Applicant: KYOCERA Document Solutions Inc., Osaka (JP)

(72) Inventor: Kuniaki Araishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/977,180

(22) Filed: May 11, 2018

(65) Prior Publication Data

US 2018/0333969 A1 Nov. 22, 2018

(30) Foreign Application Priority Data

May 16, 2017 (JP) ..... 2017-097201

(51) Int. Cl.

| | |
|---|---|
| ***G03G 15/00*** | (2006.01) |
| ***B41J 11/00*** | (2006.01) |
| ***B65H 5/38*** | (2006.01) |
| ***B65H 5/06*** | (2006.01) |
| ***B41J 13/14*** | (2006.01) |
| ***B41J 13/08*** | (2006.01) |
| ***B41J 13/00*** | (2006.01) |
| ***B41J 29/02*** | (2006.01) |

(52) U.S. Cl.

CPC ..... *B41J 11/007* (2013.01); *B41J 13/0045* (2013.01); *B41J 13/08* (2013.01); *B41J 13/14* (2013.01); *B41J 29/02* (2013.01); *B65H 5/062* (2013.01); *B65H 5/38* (2013.01)

(58) Field of Classification Search

CPC ..... B41J 11/007; B41J 13/0045; B41J 13/08; B41J 13/14; B41J 29/02; B65H 5/062; B65H 5/38

See application file for complete search history.

(56) References Cited

U.S. PATENT DOCUMENTS 7,127,195 B2 * 10/2006 Kimura ..... G03G 15/751 399/116
7,664,427 B2 * 2/2010 Kawasumi ..... G03G 21/1633 399/110

(Continued)

FOREIGN PATENT DOCUMENTS

JP 4810305 B2 8/2011

*Primary Examiner* — Hoang X Ngo
(74) *Attorney, Agent, or Firm* — Stein IP, LLC

(57) ABSTRACT

Provided is a unit including a unit case, a positioning frame, and a pair of through shafts. The unit case includes a first frame disposed on a downstream side in a mounting direction, a second frame disposed on an upstream side in the mounting direction, and a pair of end frames. The positioning frame is disposed on an upstream side in the mounting direction with respect to the second frame and is positioned in a direction perpendicular to the mounting direction with respect to an image forming apparatus main body. The through shaft penetrates the first frame, the second frame, and the positioning frame. The through shaft is provided with a regulating pin that engages with the image forming apparatus main body so as to regulate movement of the unit case in an attachment/detachment direction.

9 Claims, 7 Drawing Sheets

(56) References Cited

U.S. PATENT DOCUMENTS

| | | | | |
|---|---|---|---|---|
| 8,705,989 | B2 * | 4/2014 | Kawamura | B65H 5/062 399/21 |
| 2007/0286649 | A1 | 12/2007 | Kawasumi et al. | 399/296 |

* cited by examiner

UNIT CAPABLE OF BEING INSERTED IN AND PULLED OUT FROM IMAGE FORMING APPARATUS MAIN BODY AND IMAGE FORMING APPARATUS INCLUDING SAME

INCORPORATION BY REFERENCE

This application is based upon and claims the benefit of priority from the corresponding Japanese Patent Application No. 2017-097201 filed May 16, 2017, the entire contents of which are hereby incorporated by reference.

BACKGROUND

The present disclosure relates to a unit and an image forming apparatus including the unit. In particular, the present disclosure relates to a unit capable of being inserted in and pulled out from an image forming apparatus main body and an image forming apparatus including the unit.

Conventionally, an image forming apparatus such as a facsimile machine, a copier, or a printer has a unit such as a conveying unit or an intermediate transfer unit capable of being inserted in and pulled out from an image forming apparatus main body.

Such a unit is equipped with a box-shaped unit case including an upstream frame and a downstream frame disposed on an upstream side and a downstream side in a mounting direction, respectively, and a pair of end frames connecting the upstream frame and the downstream frame at one end side and at the other end side, respectively. Conveying rollers, an intermediate transfer belt, and the like are disposed in the unit case.

SUMMARY

A unit according to a first aspect of the present disclosure is capable of being inserted in and pulled out from the image forming apparatus main body. The unit includes a unit case, a positioning frame, and a pair of through shafts. The unit case includes a first frame disposed on a downstream side in a mounting direction so as to extend in a width direction perpendicular to the mounting direction, a second frame disposed on an upstream side in the mounting direction so as to extend in the width direction, and a pair of end frames connecting the first frame and the second frame, at one end side and at the other end side in the width direction, respectively. The positioning frame is fixed to the unit case, disposed on the upstream side in the mounting direction with respect to the second frame, extended in the width direction, and positioned in a direction perpendicular to the mounting direction with respect to the image forming apparatus main body. The pair of through shafts penetrates the first frame, the second frame, and the positioning frame, at one side and at the other side in the width direction, respectively. Each of the through shafts is provided with a regulating pin that protrudes in a radial direction of the through shaft, engages with the image forming apparatus main body so as to regulate movement of the unit case in an attachment/detachment direction.

Other objects of the present disclosure and specific advantages obtained by the present disclosure will become more apparent from the description of embodiments given below.

DETAILED DESCRIPTION

Hereinafter, an embodiment of the present disclosure is described with reference to the drawings.

Figure 1:
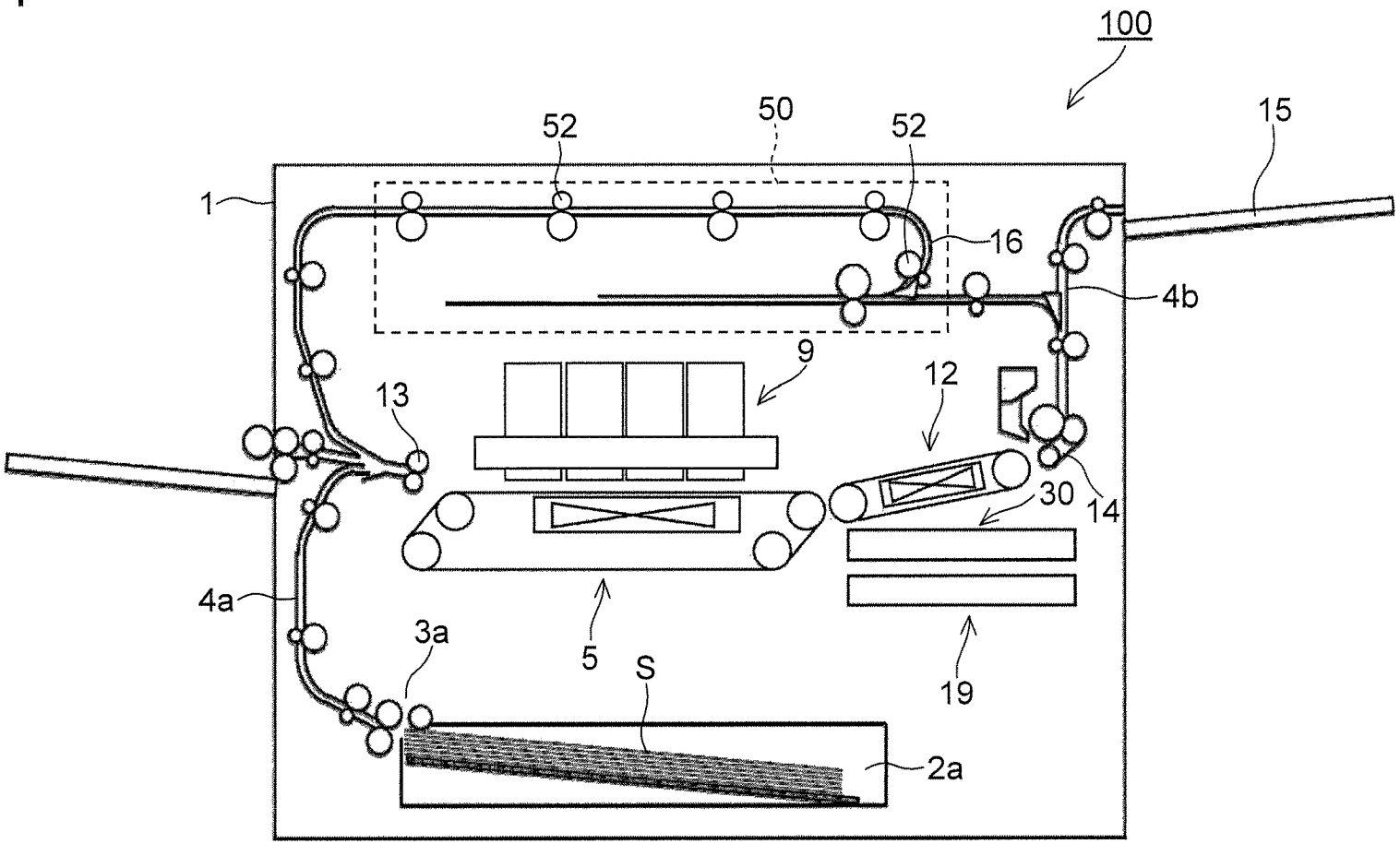
FIG. 1 is a diagram showing a schematic structure of an image forming apparatus including a sheet conveying unit of one embodiment of the present disclosure.

With reference to FIGS. 1 to 13, an inkjet type image forming apparatus 100 (e.g. a color printer) including a sheet conveying unit 50 of one embodiment of the present disclosure is described. As shown in FIG. 1, the image forming apparatus 100 includes a sheet feed cassette 2*a* as a sheet storing unit disposed in a lower part inside an apparatus main body (image forming apparatus main body) 1. The sheet feed cassette 2*a* stores paper sheets S as an example of recording media. A sheet feeding device 3*a* is disposed on a sheet conveying direction downstream side of the sheet feed cassette 2*a*, i.e. on the upper left side of the sheet feed cassette 2*a* in FIG. 1. The paper sheets S are separated one by one and sent out by this sheet feeding device 3*a* toward the upper left of the sheet feed cassette 2*a* in FIG. 1.

In addition, the image forming apparatus 100 includes inside a first sheet conveying path 4*a*. The first sheet conveying path 4*a* is disposed at the upper left of the sheet feed cassette 2*a*, which is a sheet feeding direction thereof. The paper sheet S sent out from the sheet feed cassette 2*a* is conveyed vertically upward by the first sheet conveying path 4*a* along a side surface of the apparatus main body 1.

A registration roller pair 13 is disposed at a downstream end of the first sheet conveying path 4*a* in the sheet conveying direction. Further a first conveying unit 5 and a recording unit 9 are disposed adjacent to the registration roller pair 13 on the sheet conveying direction downstream side. The paper sheet S sent out from the sheet feed cassette 2*a* passes through the first sheet conveying path 4*a* and reaches the registration roller pair 13. The registration roller pair 13 corrects skew feed of the paper sheet S and secure synchronization with an ink ejection operation performed by the recording unit 9, so as to send out the paper sheet S toward the first conveying unit 5.

A second conveying unit 12 is disposed on a downstream side of the first conveying unit 5 in the sheet conveying direction (right side in FIG. 1). The paper sheet S on which an ink image is recorded by the recording unit 9 is sent to the second conveying unit 12, and ink ejected onto a surface of the paper sheet S is dried during a period while the paper sheet S passes through the second conveying unit 12.

A decurler unit 14 is disposed on the downstream side of the second conveying unit 12 in the sheet conveying direction, in a vicinity of a right side surface of the apparatus main body 1. The paper sheet S on which the ink is dried by the second conveying unit 12 is sent to the decurler unit 14, and a curl generated in the paper sheet S is corrected.

A second sheet conveying path 4*b* is disposed on the downstream side of the decurler unit 14 in the sheet conveying direction (upper side in FIG. 1). When double-sided recording is not performed, the paper sheet S after passing the decurler unit 14 is discharged from the second sheet conveying path 4*b* onto a sheet discharge tray 15 disposed outside the right side surface of the image forming apparatus 100.

A reverse conveying path 16 for performing the double-sided recording is disposed on an upper part of the apparatus main body 1, the upper side of the recording unit 9 and the second conveying unit 12. When the double-sided recording is performed, the paper sheet S, which is after finishing recording on a first side and after passing the second conveying unit 12 and the decurler unit 14, passes the second sheet conveying path 4*b* and is sent to the reverse conveying path 16. The conveying direction of the paper sheet S sent to the reverse conveying path 16 is switched for recording on a second side next, and the paper sheet S passes an upper part of the apparatus main body 1 and is sent to the left side, passes the first sheet conveying path 4*a* and the registration roller pair 13, and is sent to the first conveying unit 5 again with the second side facing upward.

In addition, a wipe unit 19 and a cap unit 30 are disposed below the second conveying unit 12. The wipe unit 19 moves horizontally to below the recording unit 9 when purging is performed, and the wipe unit wipes out ink extruded from a discharge nozzle of a recording head of the recording unit 9 and collects the wiped-out ink. The cap unit 30 moves horizontally to below the recording unit 9 and further moves upward so as to be attached to a lower surface of the recording head when capping an ink discharging surface of the recording head of the recording unit 9.

Further in this embodiment, a part of the reverse conveying path 16 is constituted of a sheet conveying unit (a unit or a recording medium conveying unit) 50 capable of being inserted in and pulled out from the apparatus main body 1 in a front and rear direction (a direction perpendicular to a paper surface of FIG. 1). A plurality of conveying roller pairs 52 for conveying the paper sheet S are disposed along the reverse conveying path 16 in the sheet conveying unit 50.

Figure 2:
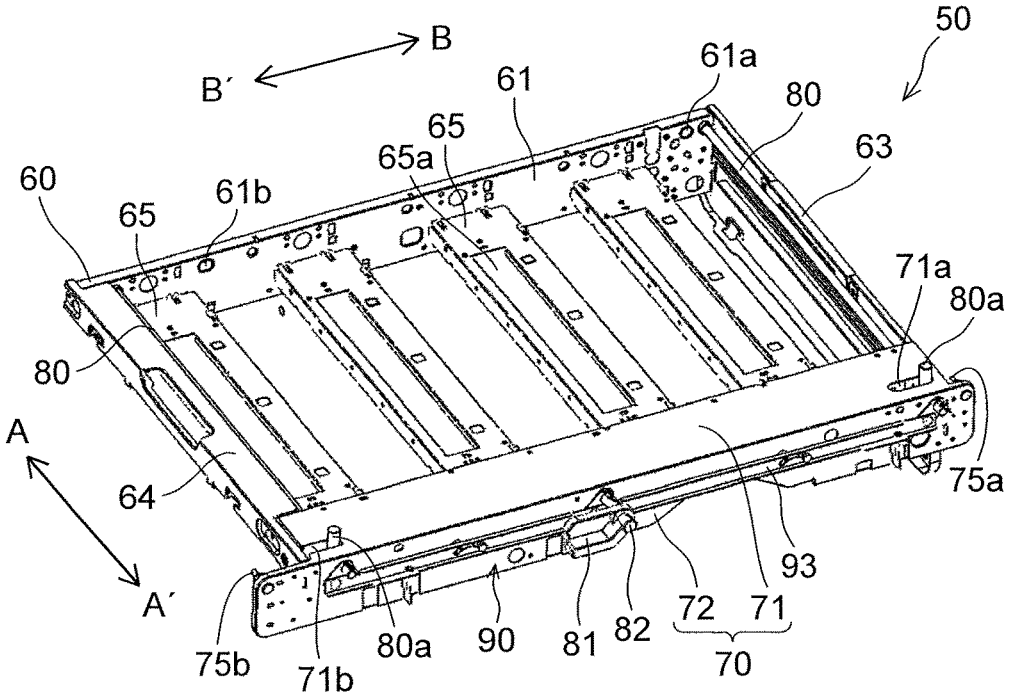
FIG. 2 is a perspective view showing a structure of the sheet conveying unit of one embodiment of the present disclosure, and is a diagram showing a state where a lock pin is positioned at an engagement position.

As shown in FIG. 2, the sheet conveying unit 50 includes a box-shaped unit case 60 that supports the plurality of conveying roller pairs 52 (see FIG. 1) in a rotatable manner and is made of sheet metal. The unit case 60 includes a first frame 61 that is disposed on the downstream side in a mounting direction of the sheet conveying unit 50 to the apparatus main body 1 (arrow A direction) and extends in a width direction (arrow BB' direction) perpendicular to the mounting direction, a second frame 62 that is disposed on the upstream side in the mounting direction of the first frame 61 and extends in the arrow BB' direction (see FIG. 3), and a pair of end frames 63 and 64 connecting the first frame 61 and the second frame 62 at one end side (ends in an arrow B direction) and at the other end side (ends in an arrow B' direction), respectively.

The first frame 61 and the second frame 62 support the plurality of conveying roller pairs 52 (see FIG. 1) in a rotatable manner. In addition, a plurality of guide frames 65 constituting a part of a lower guide surface of the reverse conveying path 16 (see FIG. 1) are fixed to the first frame 61 and the second frame 62. A slit 65*a* for exposing an upper part of a lower roller of the conveying roller pair 52 (see FIG. 1) is formed in the guide frame 65.

Figure 4:
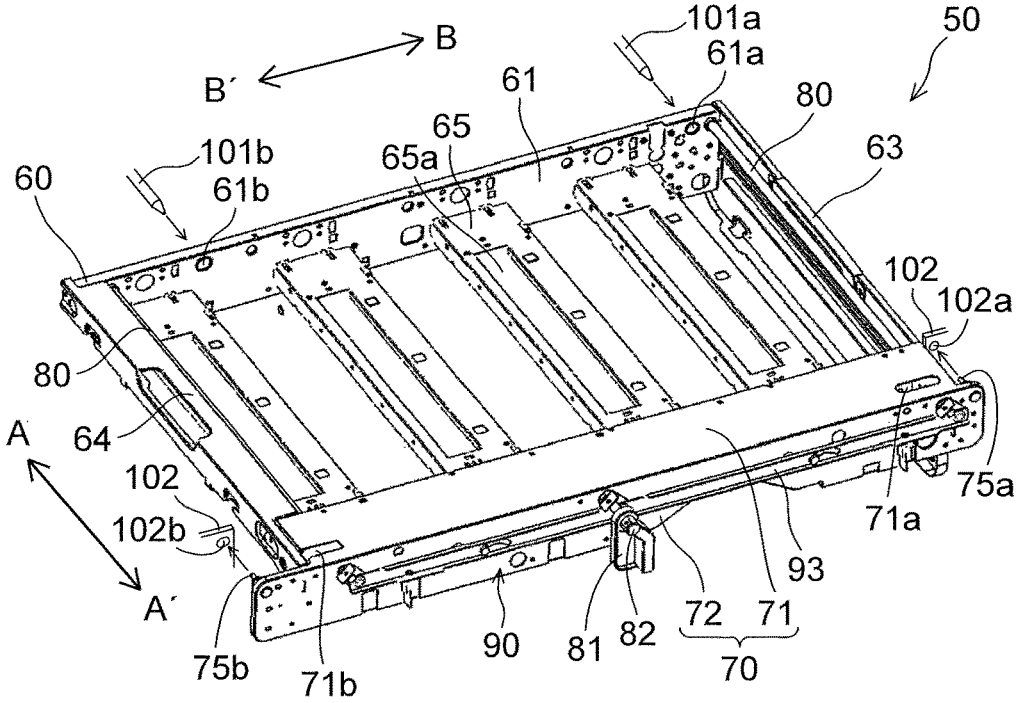
FIG. 4 is a perspective view showing a structure of the sheet conveying unit of one embodiment of the present disclosure, and is a diagram showing a state where the lock pin is positioned at a non-engagement position.

As shown in FIG. 4, positioning holes 61*a* and 61*b* in which positioning pins 101*a* and 101*b* of the apparatus main body 1 are respectively inserted are formed on both sides in the arrow BB' direction of the first frame 61. The positioning hole 61*a* is formed to have a perfect circular shape and is positioned to the apparatus main body 1 in an up and down direction and in the arrow BB' direction. The positioning hole 61*b* is formed to have a long hole shape extending in the arrow BB' direction and is positioned in the up and down direction with respect to the apparatus main body 1.

A positioning frame 70, which is disposed on the upstream side in the mounting direction with respect to the second frame 62 (see FIG. 3) and extends in the arrow BB' direction, is fixed to the unit case 60. The positioning frame 70 is formed by bending the sheet metal and is constituted of an upper surface part 71 covering the upper part of the second frame 62 and a front surface part 72 extending downward from an end of the upper surface part 71 in an arrow A' direction. The upper surface part 71 is fixed to the second frame 62, and the front surface part 72 is fixed to the end frames 63 and 64.

An opening 71*a* and a notch 71*b*, in which a lock pin 80*a* described later can be inserted, are disposed on both ends of the upper surface part 71 in the arrow BB' direction so as to extend in the arrow BB' direction.

Figure 5:
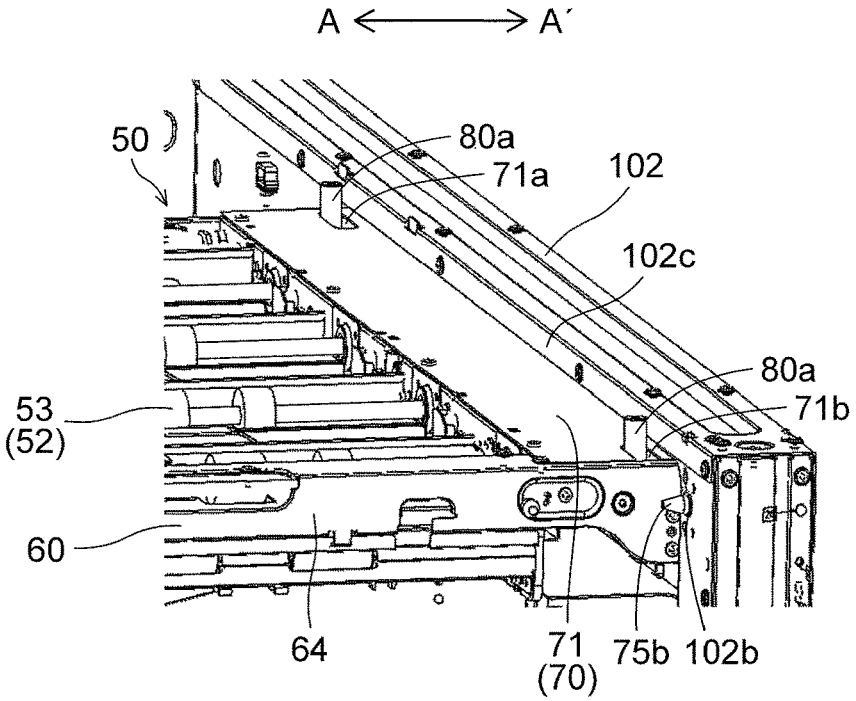
FIG. 5 is a perspective view showing a state where the lock pin of the sheet conveying unit of one embodiment of the present disclosure abuts a regulating member of a main body frame.
Figure 6:
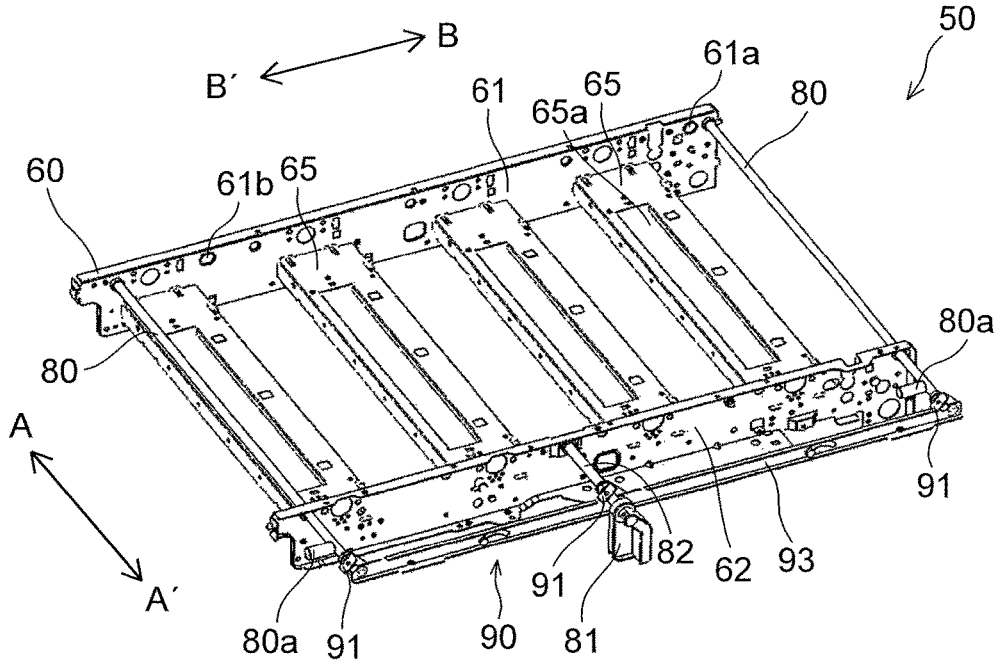
FIG. 6 is a perspective view showing a structure of the sheet conveying unit of one embodiment of the present disclosure without the end frames and the positioning frame, and is a diagram showing a state where the lock pin is positioned at the non-engagement position.

The front surface part 72 is disposed in parallel to the first frame 61 and the second frame 62, and is formed to be longer in the arrow BB' direction than each of the first frame 61 and the second frame 62. As shown in FIGS. 4 and 5, positioning protrusions (positioning parts) 75*a* and 75*b*, which protrude toward the downstream side in the mounting direction and are respectively inserted in (engaged with) positioning holes 102*a* and 102*b* of a main body frame 102 of the apparatus main body 1, are disposed on both ends of the front surface part 72 in the arrow BB' direction. The positioning hole 102*a* is formed to have a perfect circular shape and positions the positioning protrusion 75*a* in the up and down direction and in the arrow BB' direction. The positioning hole 102*b* is formed to have a long hole shape extending in the arrow BB' direction and positions the positioning protrusion 75*b* in the up and down direction. When the positioning protrusions 75*a* and 75*b* are inserted in the positioning holes 102*a* and 102*b*, respectively, the positioning frame 70 is positioned in directions (up and down direction and arrow BB' direction) perpendicular to the mounting direction with respect to the apparatus main body 1.

Figure 3:
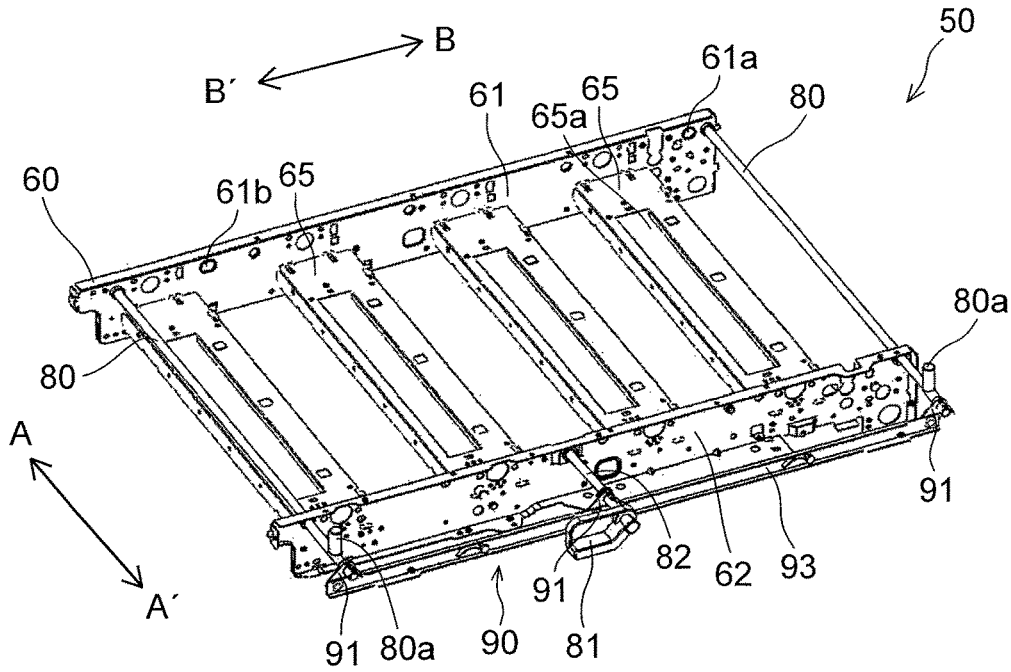
FIG. 3 is a perspective view showing a structure of the sheet conveying unit of one embodiment of the present disclosure without end frames and a positioning frame, and is a diagram showing a state where the lock pin is positioned at the engagement position.

As shown in FIGS. 2 and 3, there is disposed a pair of through shafts 80, which penetrates the first frame 61, the second frame 62, and the positioning frame 70 at one end side in the arrow BB' direction (ends in the arrow B direction) and at the other end side (ends in the arrow B' direction). The through shaft 80 is made of metal and is supported by the first frame 61, the second frame 62, and the positioning frame 70 in a rotatable manner about an axis thereof.

Each of the through shafts 80 is provided with the lock pin (regulating pin) 80*a*, which protrudes in a radial direction of the through shaft 80 and engages with the apparatus main body 1 so as to regulate movement of the unit case 60 in an attachment/detachment direction (arrow AA' direction). The lock pin 80*a* is disposed on the through shaft 80 at a position between the second frame 62 and the positioning frame 70. When the through shaft 80 rotates, the lock pin 80*a* is selectively positioned between an engagement position (shown in FIGS. 2, 3, and 5) in which it abuts (engages with) a regulating member (regulating part) 102*c* disposed on the downstream side in a pull-out direction of the lock pin 80*a* (arrow A' direction) in the main body frame 102 of the apparatus main body 1 as shown in FIG. 5, and a non-engagement position (shown in FIGS. 4 and 6) in which it does not abut the main body frame 102. The lock pin 80*a* protrudes from the opening 71*a* or the notch 71*b* in the upper surface part 71 of the positioning frame 70 when it is positioned at the engagement position, while it is positioned below the upper surface part 71 when it is positioned at the non-engagement position.

As shown in FIGS. 2 and 3, an operation lever 81 for rotating the through shaft 80 is disposed on the downstream side in the mounting direction of the positioning frame 70. The operation lever 81 is fixed to a rotation shaft 82 made of metal. The rotation shaft 82 penetrates the second frame 62 and the positioning frame 70, and is supported by the second frame 62 and the positioning frame 70 in a rotatable manner about an axis thereof.

Figure 7:
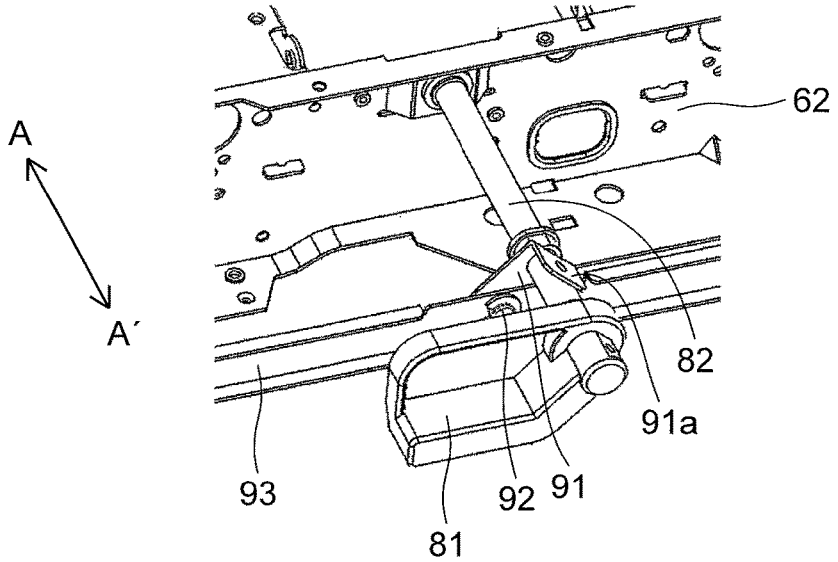
FIG. 7 is a perspective view showing a structure of an operation lever and its vicinity in FIG. 3.
Figure 8:
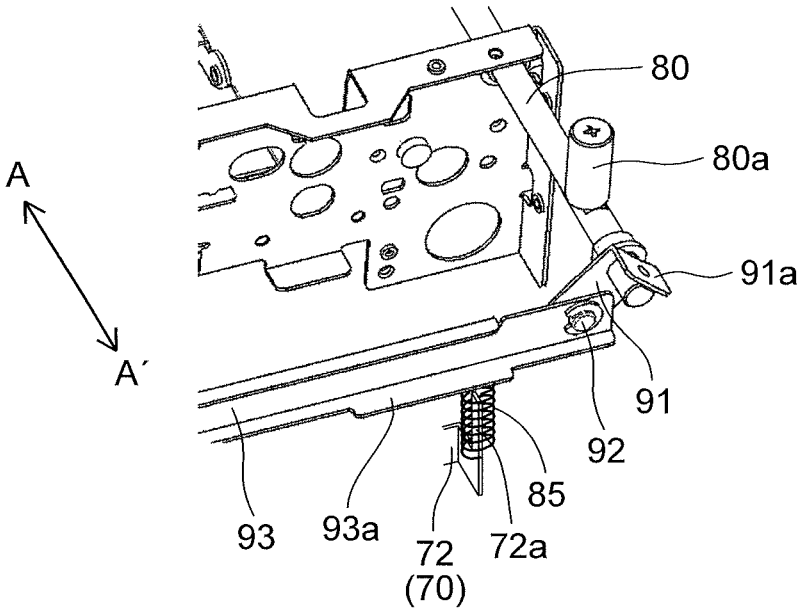
FIG. 8 is a perspective view showing a structure of the lock pin and its vicinity in an arrow B direction in FIG. 3.
Figure 9:
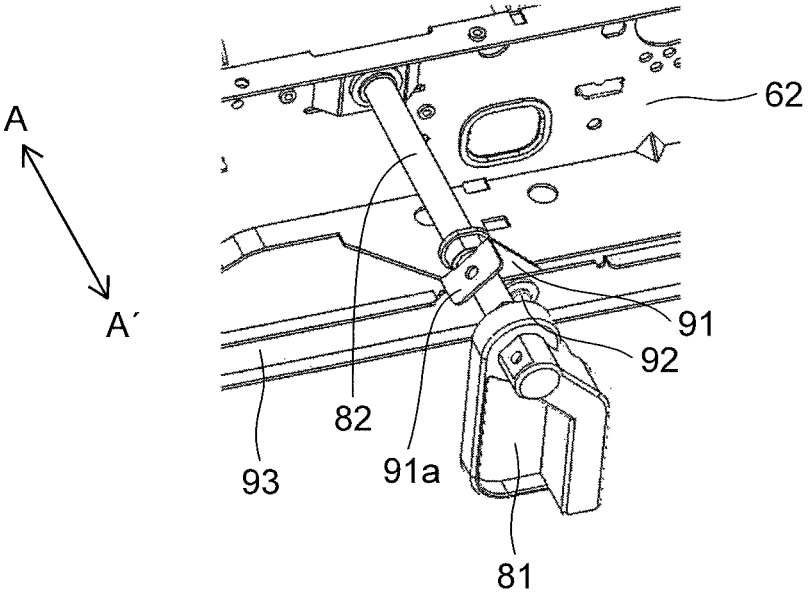
FIG. 9 is a perspective view showing a structure of the operation lever and its vicinity in FIG. 6.
Figure 10:
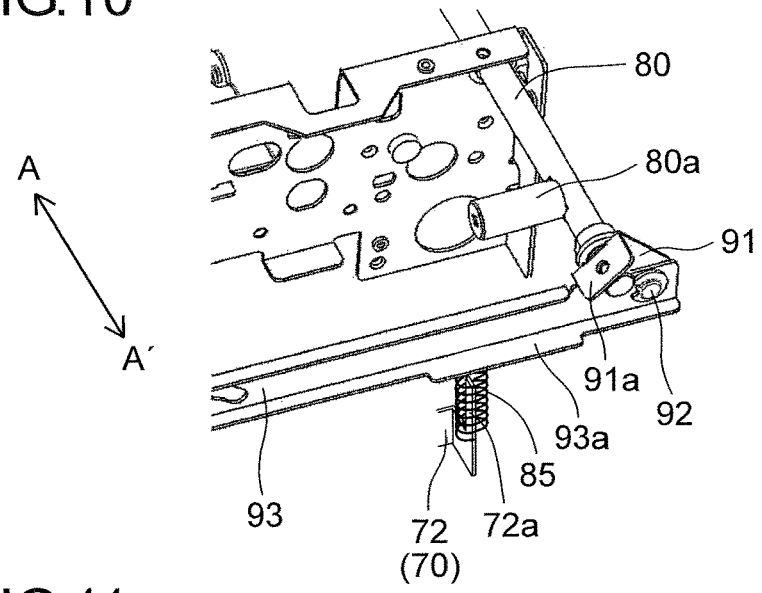
FIG. 10 is a perspective view showing a structure of the lock pin and its vicinity in the arrow B direction in FIG. 6.

The rotation shaft 82 is connected to the pair of through shafts 80 via a link mechanism 90. As shown in FIGS. 3, 7, and 8, the link mechanism 90 is constituted of three fixing pieces 91 respectively fixed to the rotation shaft 82 and the pair of through shafts 80, and a link member 93 that extends in the arrow BB' direction and is linked to the fixing piece 91 via a link shaft 92.

When the operation lever 81 is rotated about the rotation shaft 82, the link member 93 moves to a position of FIGS. 2, 3, 7, and 8, or a position of FIGS. 4, 6, 9, and 10, so that the through shaft 80 is rotated. Note that a rotation regulating part 91*a* that is bent in the arrow A' direction is disposed at an upper end part of the fixing piece 91. The rotation regulating part 91*a* abuts an upper end of the link member 93, and hence rotations of the operation lever 81, the rotation shaft 82, and the through shaft 80 are regulated within a range of approximately 90 degrees.

As shown in FIG. 8, a biased part 93*a*, which protrudes in the arrow A' direction and is biased upward by a link biasing member 85 constituted of a compression spring, is formed on each end of the link member 93. The link biasing member 85 is attached to a biasing member attachment part 72*a* that protrudes in the arrow A' direction from the front surface part 72 of the positioning frame 70 and extends upward. A biasing force of the link biasing member 85 allows the operation lever 81, the rotation shaft 82, and the through shaft 80 to be maintained at the position of FIGS. 7 and 8, or the position of FIGS. 9 and 10. In other words, the lock pin 80*a* is maintained at the engagement position or the non-engagement position.

Figure 11:
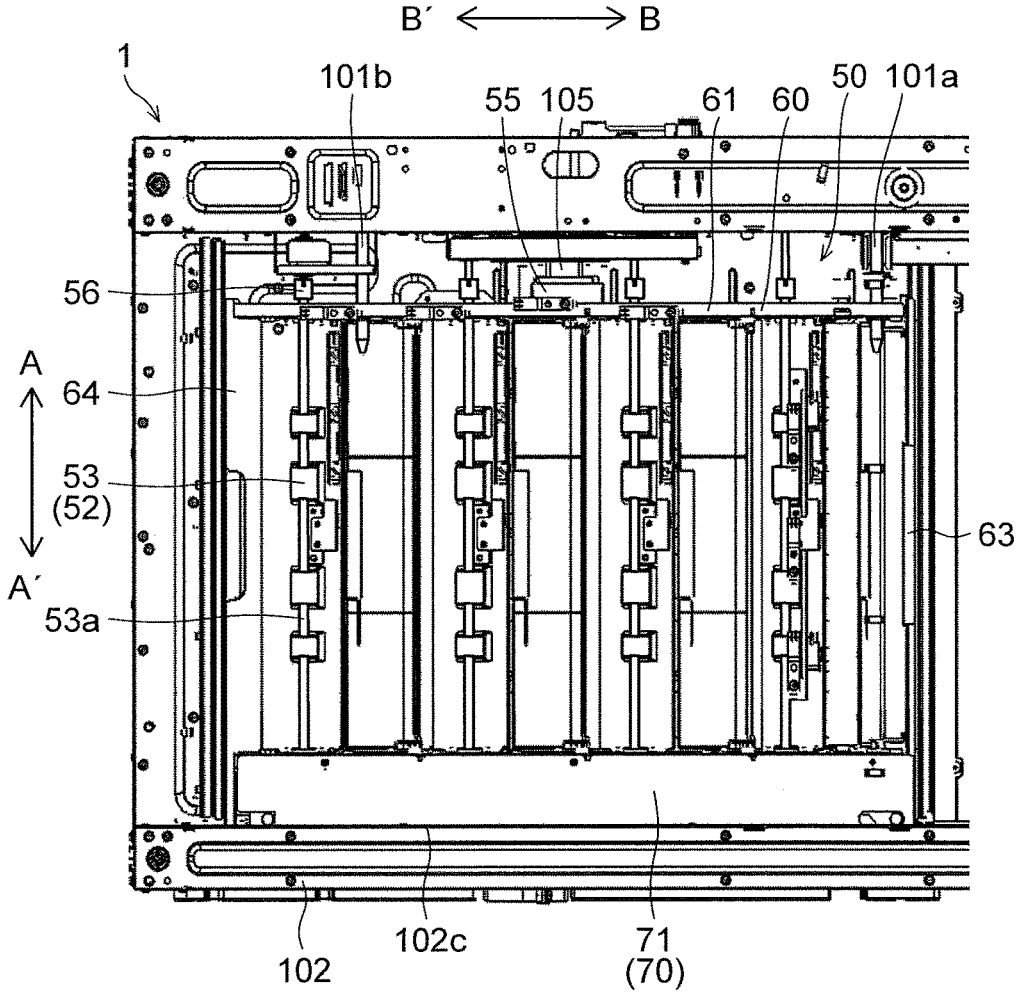
FIG. 11 is a diagram showing a state in which the sheet conveying unit of one embodiment of the present disclosure is mounted in an apparatus main body.

In addition, the unit case 60 (see FIG. 2) is biased in the pull-out direction (arrow A' direction) by a plurality of case biasing members. Specifically, as shown in FIG. 11, a unit side connector 55 is disposed on the downstream side in the mounting direction of the first frame 61. The apparatus main body 1 is provided with a main body side connector 105 that is connected to the unit side connector 55. The unit side connector 55 and the main body side connector 105 constitute a drawer connector that electrically connects the sheet conveying unit 50 and the apparatus main body 1.

Figure 12:
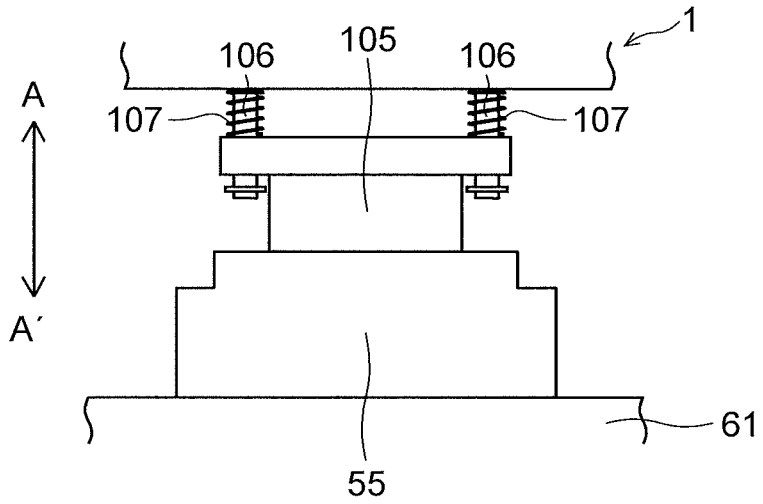
FIG. 12 is a diagram showing a structure of a unit side connector, a main body side connector, and their vicinity in FIG. 11.

As shown in FIG. 12, the main body side connector 105 is capable of sliding along two guide pins 106 extending in the arrow A' direction and is biased in the arrow A' direction by connector biasing members (case biasing members) 107 constituted of compression springs attached to the guide pins 106. Therefore, in the state where the sheet conveying unit 50 is mounted in the apparatus main body 1 (state shown in FIGS. 11 and 12), the unit case 60 is biased in the arrow A' direction by the connector biasing members 107.

Figure 13:
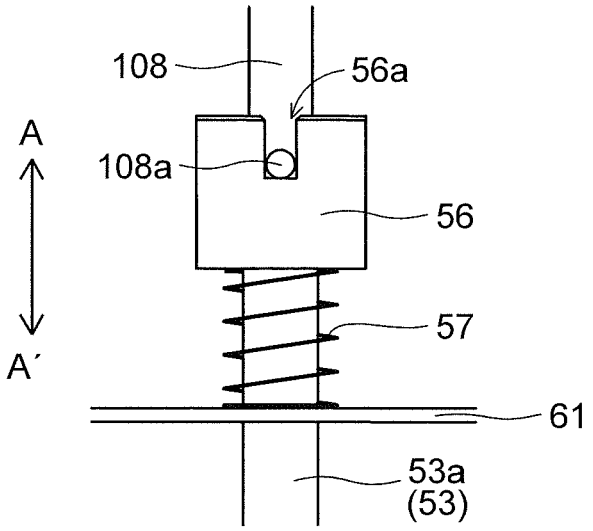
FIG. 13 is a diagram showing a structure of a unit side coupling member, an engaging pin, and their vicinity in FIG. 11.

In addition, as shown in FIGS. 11 and 13, a unit side coupling member 56 is fixed to an input end (end in the arrow A direction) of a rotation shaft 53*a* of an upper roller 53 of the conveying roller pair 52. The apparatus main body 1 is provided with a drive shaft 108 having an engaging pin 108*a* that engages with an engaging recess 56*a* of the unit side coupling member 56. The unit side coupling member 56 and the engaging pin 108*a* constitute a coupling part. A rotation drive force is transmitted to the drive shaft 108 from a not-shown drive source. The rotation drive force transmitted to the drive shaft 108 is transmitted to the rotation shaft 53*a* via the coupling part (the engaging pin 108*a* and the unit side coupling member 56), and hence the upper roller 53 is rotated.

In addition, a coupling biasing member (case biasing member) 57 constituted of a compression spring is disposed between the unit side coupling member 56 and the first frame 61. The coupling biasing member 57 is attached to the rotation shaft 53*a*. In the state where the sheet conveying unit 50 is mounted in the apparatus main body 1 (the state of FIGS. 11 and 13), the coupling biasing member 57 is compressed and biases the first frame 61 (or a not-shown bearing member for the rotation shaft 53*a*) in the arrow A' direction.

In the image forming apparatus 100 of this embodiment, when attaching the sheet conveying unit 50 to the apparatus main body 1, the sheet conveying unit 50 is moved to slide in the mounting direction (arrow A direction) from the front side of the apparatus main body 1 in the state where the lock pin 80*a* is positioned at the non-engagement position (shown in FIG. 4). In this way, the positioning pins 101*a* and 101*b* of the apparatus main body 1 are respectively inserted into the positioning holes 61*a* and 61*b* of the first frame 61, and the positioning protrusions 75*a* and 75*b* of the positioning frame 70 are respectively inserted into the positioning holes 102*a* and 102*b* of the apparatus main body 1. Then, the unit side connector 55 and the main body side connector 105 are connected to each other, and the unit side coupling member 56 and the engaging pin 108*a* are engaged with each other.

After that, when the operation lever 81 is rotated in a clockwise direction from the state of FIG. 4, the link member 93 moves from the position of FIG. 4 to the position of FIG. 2, and the through shaft 80 rotates by approximately 90 degrees in the clockwise direction. In this way, the lock pin 80*a* is positioned at the engagement position. The unit case 60 is biased in the arrow A' direction by the connector biasing members 107 and a plurality of coupling biasing members 57, so that the lock pin 80*a* abuts the regulating member 102*c* (see FIG. 5) of the main body frame 102.

On the other hand, when pulling out the sheet conveying unit 50 from the apparatus main body 1, the operation lever 81 is rotated in a counterclockwise direction from the state of FIG. 2. Then the link member 93 moves from the position of FIG. 2 to the position of FIG. 4, and the through shaft 80 rotates by approximately 90 degrees in the counterclockwise direction. In this way, the lock pin 80*a* is positioned at the non-engagement position. Further, by gripping the operation lever 81 and pulling the same in the arrow A' direction, the sheet conveying unit 50 is pulled out from the apparatus main body 1.

As described above, in this embodiment, by providing the through shafts 80 penetrating the three frames (the first frame 61, the second frame 62, and the positioning frame 70), torsional rigidity of the unit case 60 can be effectively improved, and assembly accuracy of the unit case 60 can be improved. In addition, by providing the through shafts 80 on one side and the other side in the arrow BB' direction, torsional rigidity of the unit case 60 can be more effectively improved, and assembly accuracy of the unit case 60 can be further improved. Further, because torsional rigidity of the unit case 60 can be improved, it is possible to prevent occurrence of a twist in the unit case 60.

In addition, the through shafts 80 with the lock pin 80*a* for engaging with the apparatus main body 1 so as to regulate movement of the unit case 60 in the attachment/detachment direction are disposed on one side and the other side in the arrow BB' direction. In this way, it is possible to prevent the unit case 60 from rotating in a horizontal plane.

As described above, it is possible to prevent occurrence of skew of the paper sheet S.

In addition, as described above, the through shaft 80 can rotate about the axis, and the lock pin 80*a* is selectively positioned between the engagement position for engaging with the apparatus main body 1 and the non-engagement position for not engaging with the apparatus main body 1. In this way, by rotating the through shaft 80 so that the lock pin 80*a* is positioned at the engagement position, the sheet conveying unit 50 can be easily prevented from moving in the pull-out direction (being pulled out) from the apparatus main body 1. In addition, by rotating the through shaft 80 so that the lock pin 80*a* is positioned at the non-engagement position, the sheet conveying unit 50 can be easily pulled out.

In addition, as described above, the operation lever 81, the rotation shaft 82 for supporting the operation lever 81 in a rotatable manner, and the link mechanism 90 for linking the rotation shaft 82 and the pair of through shafts 80 are provided. In this way, by operating the one operation lever 81, two lock pins 80*a* can be simultaneously positioned selectively between the engagement position and the non-engagement position.

In addition, as described above, the rotation shaft 82 penetrates the positioning frame 70 and the second frame 62. In this way, torsional rigidity of the unit case 60 can be further improved.

In addition, as described above, the link biasing member 85 is provided, which biases the link mechanism 90 so as to regulate rotation of the rotation shaft 82 in the state where the lock pin 80*a* is positioned at the engagement position or the non-engagement position. In this way, it is possible to prevent the through shaft 80 from unintentionally moving due to vibration or the like.

In addition, as described above, the unit case 60 is biased by the case biasing member (the coupling biasing member 57 and the connector biasing member 107) in the pull-out direction, and the lock pin 80*a* abuts the regulating member 102*c* of the apparatus main body 1. In this way, movement of the unit case 60 in the attachment/detachment direction can be easily prevented.

In addition, as described above, the positioning frame 70 is provided with the positioning protrusions 75*a* and 75*b*. In this way, the unit case 60 can be easily positioned in the direction perpendicular to the mounting direction with respect to the apparatus main body 1. In addition, by providing the positioning protrusions 75*a* and 75*b* on both ends in the arrow BB' direction, it is possible to prevent occurrence of a twist in the unit case 60, and positioning accuracy of the unit case 60 can be further improved.

Note that the embodiment disclosed above is merely an example in every aspect and should not be interpreted as a limitation. The scope of the present disclosure is defined by not the above description of the embodiment but by the claims and should be understood to include all modifications within meanings and scopes equivalent to the claims.

For example, in the embodiment described above, the example of applying the present disclosure to the inkjet type image forming apparatus is described, but without limiting to this, the present disclosure can be applied to any image forming apparatus other than the inkjet type (e.g. an electrophotographic type image forming apparatus).

In addition, in the embodiment described above, the example of applying the present disclosure to the sheet conveying unit 50 is described, but without limiting to this, the present disclosure can be applied to an intermediate transfer unit or other unit.

In addition, the embodiment described above shows the example in which the first frame 61 is provided with the positioning holes 61*a* and 61*b*, and the positioning frame 70 is provided with the positioning protrusions 75*a* and 75*b*, for positioning the sheet conveying unit 50 to the apparatus main body 1, but the present disclosure is not limited to this. For example, the first frame 61 may be provided with the positioning protrusion while the positioning frame 70 may be provided with the positioning hole (positioning part).

In addition, the embodiment described above shows the example in which the decurler unit 14 is disposed separately from the sheet conveying unit 50, but the decurler unit 14 may be disposed in the sheet conveying unit 50.

What is claimed is:

1. A unit capable of being inserted in and pulled out from an image forming apparatus main body, comprising:

a unit case including a first frame disposed on a downstream side in a mounting direction so as to extend in a width direction perpendicular to the mounting direction, a second frame disposed on an upstream side in the mounting direction so as to extend in the width direction, and a pair of end frames connecting the first frame and the second frame, at one end side and at the other end side in the width direction, respectively;

a positioning frame fixed to the unit case, disposed on the upstream side in the mounting direction with respect to the second frame, extended in the width direction, and positioned in a direction perpendicular to the mounting direction with respect to the image forming apparatus main body; and a pair of through shafts penetrating the first frame, the second frame, and the positioning frame, at one side and at the other side in the width direction, respectively, wherein each of the through shafts is provided with a regulating pin protruding in a radial direction of the through shaft, the regulating pin engaging with the image forming apparatus main body so as to regulate movement of the unit case in an attachment/detachment direction.

2. The unit according to claim 1, wherein the through shaft is capable of rotating about an axis thereof, and the regulating pin is selectively positioned between an engagement position for engaging with the image forming apparatus main body and a non-engagement position for not engaging with the image forming apparatus main body.

3. The unit according to claim 2, further comprising:

an operation lever for rotating the through shaft;

a rotation shaft for supporting the operation lever in a rotatable manner; and a link mechanism for linking the rotation shaft and the pair of through shafts, wherein the operation lever rotates about the rotation shaft, so that the regulating pin is selectively positioned between the engagement position and the non-engagement position.

4. The unit according to claim 3, wherein the rotation shaft penetrates the positioning frame and the second frame.

5. The unit according to claim 3, further comprising a link biasing member for biasing the link mechanism so as to regulate rotation of the rotation shaft in a state where the regulating pin is positioned at the engagement position or the non-engagement position.

6. The unit according to claim 1, further comprising a case biasing member for biasing the unit case in a pull-out direction, wherein a biasing force of the case biasing member causes the regulating pin to abut a regulating part disposed on a downstream side in the pull-out direction of the unit case in the image forming apparatus main body.

7. The unit according to claim 1, wherein each end in the width direction of the positioning frame is provided with a positioning part that engages with the image forming apparatus main body and is positioned in a direction perpendicular to the mounting direction.

8. The unit according to claim 1, which is a recording medium conveying unit for conveying a recording medium.

9. An image forming apparatus comprising:

the unit according to claim 1; and an image forming apparatus main body.

* * * * *